US005360502A

United States Patent [19]

Andersson

[11] Patent Number: 5,360,502

[45] Date of Patent: Nov. 1, 1994

[54] METHOD AND APPARATUS FOR SPLICING AT LEAST TWO SINGLE OR MULTIPLE LAYER MATERIALS COMPRISING AIR PERMEABLE SOFT PAPER WEBS

[75] Inventor: Karl G. B. Andersson, Halmstad, Sweden

[73] Assignee: Duni AB, Sweden

[21] Appl. No.: 934,535

[22] PCT Filed: Apr. 11, 1991

[86] PCT No.: PCT/SE91/00265

§ 371 Date: Oct. 6, 1992

§ 102(e) Date: Oct. 6, 1992

[87] PCT Pub. No.: WO91/16256

PCT Pub. Date: Oct. 31, 1991

[30] Foreign Application Priority Data

Apr. 18, 1990 [SE] Sweden ..... 9001384-8

[51] Int. Cl.[5] ..... B65H 21/00

[52] U.S. Cl. ..... 156/159; 156/285; 156/504

[58] Field of Search ..... 156/157, 159, 504, 285; 493/381, 464; 29/DIG. 78; 269/21; 242/58.1; 264/511

[56] References Cited

U.S. PATENT DOCUMENTS

| | | | |
|---|---|---|---|
| 2,753,181 | 7/1956 | Anander | 269/21 X |
| 3,061,220 | 10/1962 | Gagg et al. | 156/504 X |
| 3,132,544 | 5/1964 | Jones | 269/21 X |
| 3,554,842 | 12/1971 | Byrt . | |
| 3,738,587 | 6/1973 | Christiani . | |
| 3,741,116 | 6/1973 | Green et al. | 269/21 X |
| 4,097,323 | 6/1978 | De Roeck et al. . | |
| 4,629,531 | 12/1986 | Kataoka | 156/504 |
| 4,902,366 | 2/1990 | Bader | 156/209 X |
| 5,018,535 | 5/1991 | Da Silva et al. | 156/159 X |

FOREIGN PATENT DOCUMENTS

| | | |
|---|---|---|
| 0318427 | 5/1989 | European Pat. Off. . |
| 0321247 | 6/1989 | European Pat. Off. . |
| 0395028 | 10/1990 | European Pat. Off. . |
| 461036 | 12/1989 | Sweden . |

*Primary Examiner*—Mark Osele

[57] ABSTRACT

A method and apparatus for splicing at least two single or multiple layer materials of air permeable soft paper webs while retaining web tension during operation. The apparatus includes a first suction chamber for retaining an end portion of a new web in trailing engagement against a first web, which is to be spliced, a second suction chamber over which moves the first web, which is to be spliced, as well as the forward end portion of the new web for splicing, a regulatable vacuum system for the suction chambers, an embossing nip placed downstream of the second suction chamber for bonding together the webs kept together with the aid of controlled air passage through them, and a cutting means for cutting off the moving web. Splicing takes place by vacuum in both suction chambers arranged at the webs for entraining the end portion of the new web to the first web which is to be spliced in the embossing nip, where bonding of both material webs takes place such as to form a reliable splice, subsequent to which the moving web is cut off for completing the splicing operation.

4 Claims, 2 Drawing Sheets

METHOD AND APPARATUS FOR SPLICING AT LEAST TWO SINGLE OR MULTIPLE LAYER MATERIALS COMPRISING AIR PERMEABLE SOFT PAPER WEBS

BACKGROUND OF THE INVENTION

1. Field of the Invention

The present invention relates to a method and apparatus for splicing at least two single or multiple layer materials comprising air permeable soft paper webs.

2. Description of the Prior Art

An usual method of splicing web material has so far been to stop the material web which is to be spliced and thereafter to manually tape the old material web to a new material web. For providing a more secure splice between two multiple layer materials it is usual to tape both sides of the departing material web so that the upper and lower layers of the respective material web are joined together. A natural result of this splicing method is that the web tension, which is important for carrying out the process, is lost. Starting up again after splicing and retrieving the web tension results in undesired material waste. Another method used for simple material webs has been to use vacuum for providing a temporary positional fixation of the new material web in relation to the old one which is to be spliced, the speed of the web which is to be spliced being lowered at a predetermined splicing instant sufficiently for the new material web to be fixed against the old one with the aid of rapidly setting glue or a tape arrangement when the webs come together and the vacuum is released. This method has been found unsuitable for thin multiple layer soft paper material due to only one of the layers in the respective material web being joined to each other.

SUMMARY OF THE INVENTION

One object of the present invention is to achieve a method and apparatus for splicing soft paper webs in particular, the above mentioned drawbacks having been completely eliminated while the material waste at the splice location is very small.

This and other objects of the present invention are achieved by a method of splicing at least two single or multiple layer materials comprising air permeable soft paper webs while maintaining unaltered web tension during the splicing operation. The method is characterized in that splicing of a new web to a moving web is carried out by positionally fixing the forward end portion of the new web with the aid of vacuum in a manner known per se against a first suction chamber. The end portion is thereby retained in a position with an outmost part of the end portion of the new web trailing against the moving web at a second suction chamber over which the moving web passes. A suction force in the form of a controlled air flow through both material webs being generatable with the aid of this second suction chamber, and for a predetermined time the suction force in the second suction chamber is actuated for full entraining effect simultaneously as the first suction force in the first suction chamber is released, the departing web taking with it the new web, by reason of the vacuum in the second suction chamber, into an embossing nip now activated to its embossing setting, subsequent to which the moving web is cut off for completion of the splicing operation.

The present invention further provides an apparatus for splicing at least two single or multiple layer materials comprising air permeable soft paper webs while maintaining web tension during operation. The apparatus is characterized in that it includes a first suction chamber for retaining an end portion of a new web such as to provide trailing engagement against the moving web which is to be spliced. A second suction chamber over which the web for splicing moves, and over which the forward end portion of the new web also trails before splicing. A regulatable vacuum system for the suction chambers, an embossing nip placed downstream of the second suction chamber for bonding together the webs kept together with the aid of controlled air passage through them, and a cutting means for cutting off the moving web.

There has now been provided in accordance with the invention a method and apparatus for splicing at least two single or multiple layer materials comprising air permeable soft paper webs, where the splicing itself can be carried out without additional material and continuity of the web feed during operation can be maintained for subsequent operations at the same time.

BRIEF DESCRIPTION OF THE DRAWINGS

The invention will now be described in more detail below, with reference to the accompanying drawings, where FIG. 1 schematically illustrates a preferred embodiment of an apparatus for carrying out the method in accordance with the present invention.

DETAILED DESCRIPTION OF EMBODIMENTS OF THE INVENTION

Figure 1:
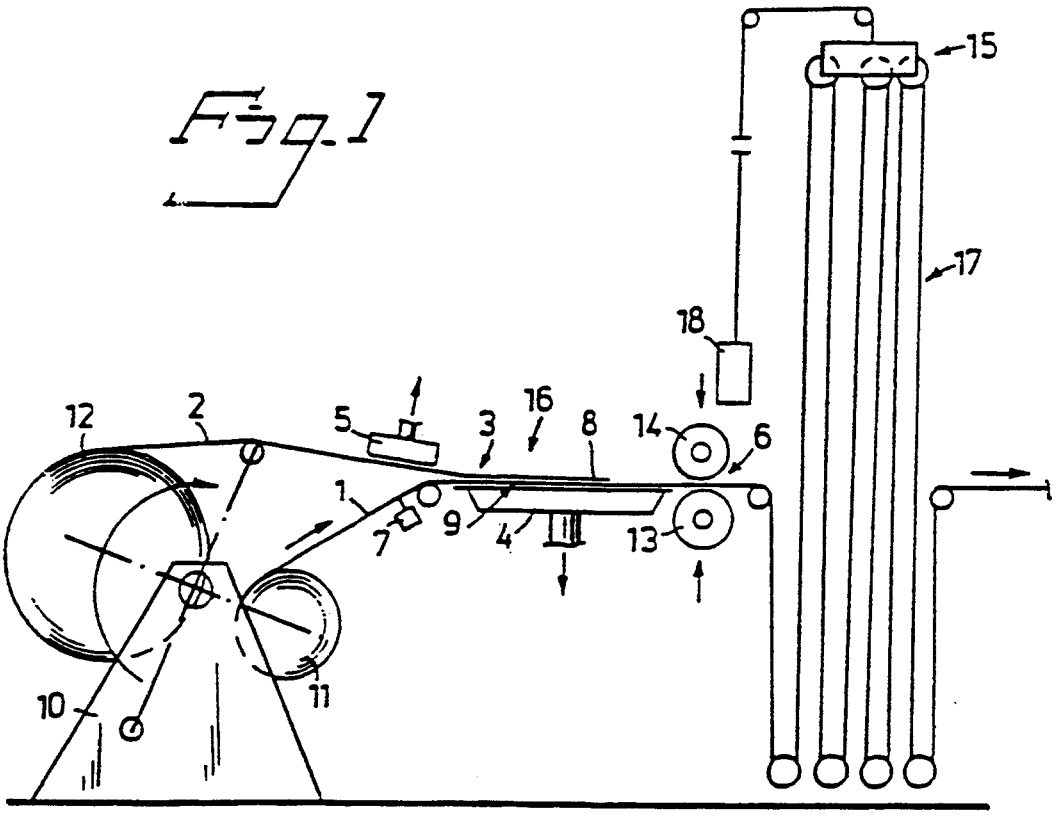

In FIG. 1 there is shown a preferred, first embodiment of a splicing apparatus in accordance with the present invention, where a roll stand 10 is formed for carrying two rotatably mounted material rolls 11, 12. Associated with the rolls, 11, 12 there is a web fixation means 16, in juxtaposition with an embossing nip 6, after which there is arranged a paper buffer store 17 with at least one balancing means 18. The web fixation means 16 includes a first suction chamber 5 for retaining an end portion 3 of a new web 2 so that the end portion 3 can trail against the web 1, which is to be spliced. This web 1 extends over a second suction chamber 4, over which also trails the outmost portion 8 of the end portion 3 trailing against the web 1. In addition, there is an unillustrated regulatable vacuum system for the suction chambers 4 and 5. The embossing nip 6 is placed downstream of the second suction chamber 4 for joining the webs 1 and 2, which are kept together with the aid of controlled air passage through them. Close to the web 1 which is to be joined, there is a cutting means 7, e.g. in the form of a pneumatically driven, transversally moving knife for cutting the web 1 after the splicing operation.

Splicing the material web 1 and 2 is performed in the following manner. Splicing in a new material web 2 from a roll 12 on the roll stand 10 is prepared by the forward end portion 3 of the new web 2 being placed over the material web 1 coming from the roll 11, and which is to be replaced. The end portion 3 is now positionally fixed with the aid of vacuum from the first suction chamber 5. In this position the outmost part 8 of the end portion 3 trails against the moving web 1 over a region 9 associated with the second suction chamber 4. Certain web materials which glide against each other generate static electricity, resulting in that the material surfaces are attracted to each other. A soft paper web in the form of a multiple layer tissue which is to be processed should suitably be conditioned to a moisture value in the material counteracting the generation of static electricity. In order to achieve a material-tensioning friction force between both material webs 1 and 2, a controlled air flow can be utilized, this air flow passing through the material webs towards the suction chamber 4. Positional fixation of the new material web 2 takes place by it being kept fixed against the first suction chamber 5, situated above and close to the new material web 2 and in close association with the underlying suction chamber 4. The outmost part 8 of web 2 is in this position at a safe distance from the embossing nip 6, which comprises embossing rolls 13 and 14. The actual splicing operation takes place in the following manner. The roll 11 with the web which is to be replaced is braked to a lower speed and web material will move out from a material buffer store 17, so that the web tension can be maintained unaltered, this being possible by an upper roll set 15 in the store 17 moving downwards. At a given signal the rolls 13 and 14, now running synchronously with the web fixation means 16, are urged together in the embossing nip, the suction force in the suction chamber 4 being increased simultaneously as the retaining force in the first suction chamber 5 ceases and the new roll 12 is started up by a drive means not illustrated on the drawing. When the outmost part 8 of the end portion 3 of the web 2 passes in between the embossing rolls 13 and 14 together with the old material web 1, this web is cut off by the cutting means 7 which includes the pneumatically driven transversally moving knife. The splicing sequence is carried out in a couple of seconds, and for this reason the length of the double multiple layer material in the embossed splice is limited. If a process machine is automatically regulated to a lower speed in connection with splicing, full control of web tension as well as the register of printing and border embossing can be maintained.

Figure 2:
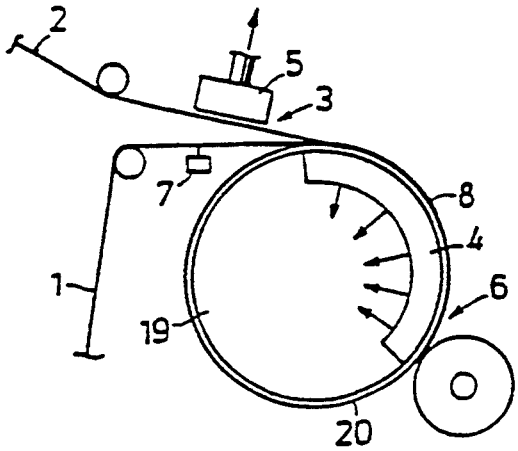
FIG. 2 schematically illustrates an alternative embodiment of an apparatus for carrying out the method in accordance with the invention and FIG. 3 schematically illustrates a third embodiment of an apparatus for carrying out the method in accordance with the present invention.

FIG. 2 illustrates an alternative embodiment of a splicing apparatus for carrying out the method in accordance with the present invention. Shown here are the new web 2 and the web 1, which are to be spliced, both these webs coming from rolls not shown on the drawing. In this example a suction chamber 4 is arranged inside a drum 19 within its cylindrical surface 20 and the embossing nip 6 is formed between this drum 19 and the embossing roll 14. Downstream of the roll nip 6 there may be a paper buffer store with counterweight means as in the first embodiment.

Figure 3:
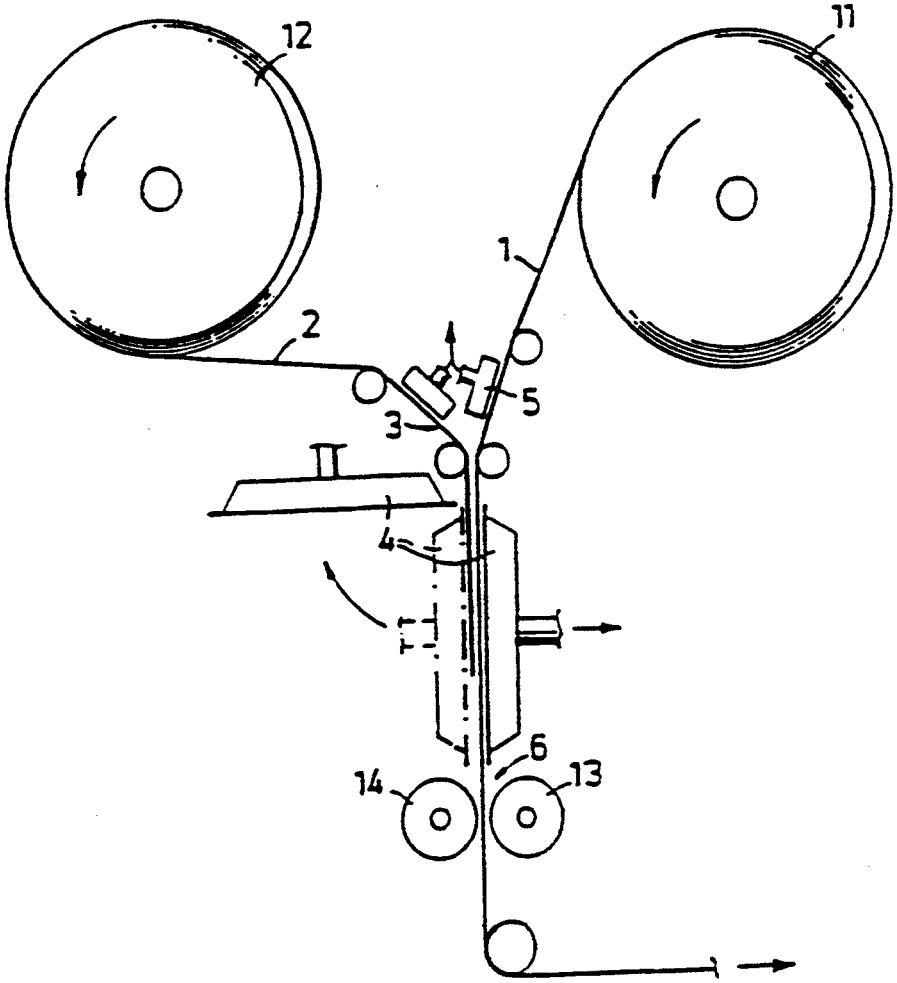

The described splicing technique for air permeable single or multiple layer materials can also be applicable to rolling off from rolls with web ruptures to rolls where the webs have received overlapped, embossed fixation splices, and in FIG. 3 there is shown a third embodiment of an apparatus for carrying out the splicing method in accordance with the present invention. Here it is assumed that the rolling-off station includes at least two rolling off positions, i.e. rolls 11, 12, and that the web rupture locations are indicated by marking one or both end sides of either roll 11, 12, or that the web rupture positions are given as a number of meters or roll turns from the instant the material starts to be taken from either of the rolls 11, 12. Due to the present invention there is no principle difficulty in the number of ruptures per roll being more than one, providing information as to the number of ruptures and their locations are suitably defined, e.g. by a bar code on the content description of the respective roll 11, 12.

When a rupture in the web on the first, rotating roll 11 in FIG. 3 is signalled, it has been assumed that the splice has been prepared for the second roll 12, from which the web 2 extends and is retained with the aid of a first suction chamber 5 so that the outmost part 8 of the end portion 3 of the web 2 trails against the moving web 1. Immediately prior to the rupture location the splice is made automatically by speed restriction and, by increased vacuum in the suction chamber 4, increasing the trailing pressure for the new web 2, full extension thus being obtained as well as optimum traction force for the new web 2 together with web 1. Webs 1 and 2 are now embossed when they come into the embossing nip 6, subsequent to which the old web 1 is cut off. Preparations are then made immediately for splicing the web 2 coming from the roll 12. Carrying out the above mentioned technique assumes that the number of suction chambers 4 is doubled such that there is one for each material web 1 and 2, so that drawing in to the common embossing nip 6 can be carried out for the two webs 1, 2 lying one above the other. The suction chamber 4 which is not used can be swung to one side, or swung upwards from the webs 1, 2 in some suitable manner, not illustrated on the drawing. The technique is however the same as applies for splicing at the end of a roll, i.e. that the suction chamber 4 is placed along the material web which is to be spliced according to the embodiment described first.

In the case where the invention is applied to air permeable material webs, and these include layers or constituents which will stick together when warm, bonding together in the embossing nip 6 of both webs 1, 2 can be achieved with the aid of heat, and this can be transmitted to the web material, e.g. by one of the rolls 13, 14; 19 forming the embossing nip 6.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

I claim:

1. An apparatus for splicing at least two single or multiple layer materials comprising air permeable soft paper webs while substantially maintaining web tension during the splicing operation, the apparatus comprising a first suction chamber for retaining a forward end portion of the new web such as to provide trailing contact against a moving web which is to be spliced, a second suction chamber over which the web to be spliced moves, and over which the forward end portion of the new web also passes before splicing, a regulatable vacuum system for the suction chambers, an embossing nip placed downstream of the second suction chamber for bonding together the webs kept together with the aid of controlled air passage through them, and a cutting means for cutting off the moving web.

2. Apparatus as claimed in claim 1, characterized in that the embossing nip includes at least two opposing embossing rolls of which at least one is heatable.

3. A method of splicing a moving web and a new web, each web comprising single or multiple layer materials comprising air permeable soft paper, and web tension being maintained substantially unaltered during the splicing, the method comprising the steps of:

(a) applying a first suction force by a first suction chamber on a forward end portion of the new web thereby positioning the forward end portion so that a leading part of the forward end portion is in trailing contact against a surface of the moving web at a second suction chamber over which the moving web passes, a second suction force in the form of a controlled air flow through the materials of both webs being generatable with the second suction chamber;

(b) applying the second suction force by the second suction chamber simultaneously as the first suction force by the first suction chamber is released, so that the moving web takes the new web with it into an embossing nip under action of the second suction force;

(c) activating the embossing nip to an embossing setting; and (d) cutting off the moving web thereby splicing the new web to the moving web.

4. The method of claim 3, wherein the second suction force is applied for a predetermined time such that the new web is entrained by the moving web and moves with the moving web to the embossing nip.

* * * * *